US005297570A

United States Patent [19]

Conner

[11] Patent Number: 5,297,570

[45] Date of Patent: Mar. 29, 1994

[54] GOLF BAG UMBRELLA

[76] Inventor: Warren D. Conner, Rte. 1, Box 1286, Scottsburg, Va. 24589

[21] Appl. No.: 933,764

[22] Filed: Aug. 24, 1992

[51] Int. Cl.[5] ..... A45B 3/00

[52] U.S. Cl. ..... 135/16; 135/25.1; 403/229

[58] Field of Search ..... 135/16, 25.1, 25.4, 135/75, 118, 119; 403/372, 203, 223, 229, 220

[56] References Cited

U.S. PATENT DOCUMENTS

| | | | |
|---|---|---|---|
| 2,578,887 | 12/1951 | Jackson et al. | 403/229 X |
| 3,040,477 | 6/1962 | June | 135/118 X |
| 3,044,476 | 7/1962 | Avery | 135/118 X |
| 3,182,672 | 5/1965 | Biller, Jr. | 135/118 X |
| 3,304,035 | 2/1967 | Davis | 135/75 X |
| 3,437,059 | 4/1969 | Stonier et al. | 403/220 X |
| 3,866,934 | 2/1975 | Braun | 135/16 X |
| 3,979,120 | 9/1976 | Dietrich | 403/229 X |
| 3,999,730 | 12/1976 | Gonsalves et al. | 403/220 X |
| 4,332,399 | 6/1982 | Kepple | 403/229 X |
| 4,522,300 | 6/1985 | Hamblet | 135/16 X |
| 4,528,998 | 7/1985 | Gamm | 135/75 |
| 4,603,904 | 8/1986 | Tolleson et al. | 403/223 X |
| 4,788,996 | 12/1988 | Forshee | 135/16 |
| 4,953,576 | 9/1990 | Connelly | 135/118 |
| 5,025,819 | 6/1991 | Taylor | 135/16 |

FOREIGN PATENT DOCUMENTS

| | | | |
|---|---|---|---|
| 6423 | 3/1933 | Australia | 135/16 |
| 4434924 | 2/1950 | Italy | 135/16 |
| 20655 | of 1895 | United Kingdom | 403/229 |

*Primary Examiner*—Carl D. Friedman
*Assistant Examiner*—Lan C. Mai
*Attorney, Agent, or Firm*—Leon Gilden

[57] ABSTRACT

A golf bag umbrella is mounted within a golf bag and includes a central spring connection mounted to an extension shaft to permit pivotal displacement of the umbrella structure for access to golf clubs and the associated golf bag.

3 Claims, 4 Drawing Sheets

FIG 8
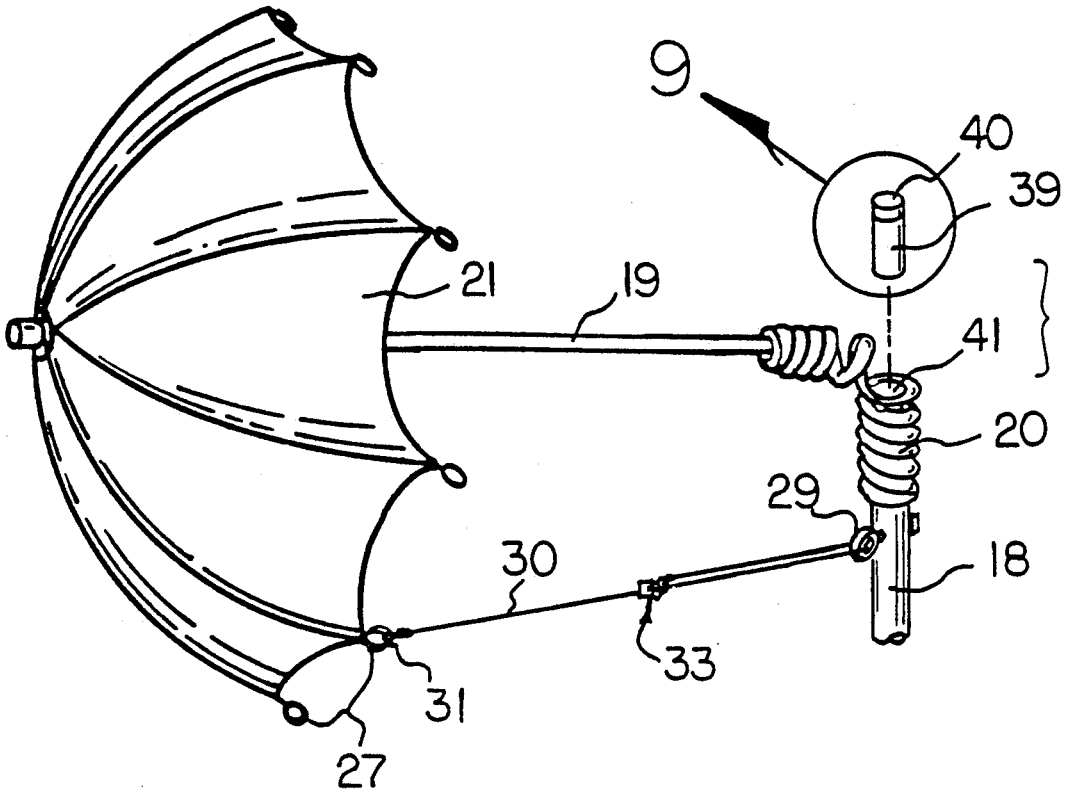
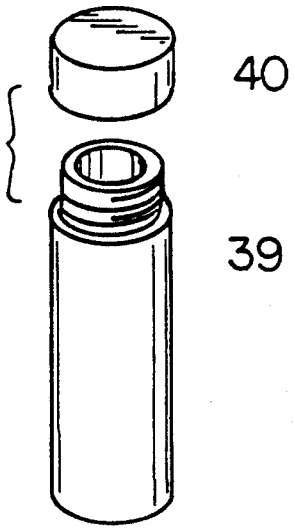
FIG 9

GOLF BAG UMBRELLA

BACKGROUND OF THE INVENTION

1. Field of the Invention

The field of invention relates to umbrella structure, and more particularly pertains to a new and improved golf bag umbrella wherein the same is arranged for pivotal mounting to permit access to golf clubs in the golf bag.

2. Description of the Prior Art

Various umbrella-like structure has been utilized in the prior art and exemplified in the U.S. Pat. No. 4,788,996 to Forshee wherein an umbrella-like cover is arranged for mounting overlying golf clubs providing for a rain cover. In a similar manner, U.S. Pat. No. 5,005,623 to Webster sets forth a rain cover for mounting overlying an upper edge or entrance opening of the golf bag.

Similar rain hood type structure is set forth in the U.S. Pat. Nos. 3,977,451 to Duba; 4,953,768 to Muso; and 4,699,164 to Pilney, et al.

Accordingly, it may be appreciated there continues to be a need for a new and improved golf bag umbrella as set forth by the instant invention which addresses both the problems of ease of use as well as effectiveness in construction in permitting positioning of the umbrella structure within the golf bag while simultaneously permitting access to golf clubs within the golf bag structure and in this respect, the present invention substantially fulfills this need.

SUMMARY OF THE INVENTION

In view of the foregoing disadvantages inherent in the known types of umbrella apparatus now present in the prior art, the present invention provides a golf bag umbrella wherein the same utilizes a central spring hinge structure to permit access to golf clubs within the underlying golf bag. As such, the general purpose of the present invention, which will be described subsequently in greater detail, is to provide a new and improved golf bag umbrella which has all the advantages of the prior art golf bag cover structure and none of the disadvantages.

To attain this, the present invention provides a golf bag umbrella mounted within a golf bag and including a central spring connection mounted to an extension shaft to permit pivotal displacement of the umbrella structure for access to golf clubs and the associated golf bag.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf bag umbrella which has all the advantages of the prior art umbrella apparatus and none of the disadvantages.

It is another object of the present invention to provide a new and improved golf bag umbrella which may be easily and efficiently manufactured and marketed.

It is a further object of the present invention to provide a new and improved golf bag umbrella which is of a durable and reliable construction.

An even further object of the present invention is to provide a new and improved golf bag umbrella which is susceptible of a low cost of manufacture with regard to both materials and labor, and which accordingly is then susceptible of low prices of sale to the consuming public, thereby making such golf bag umbrellas economically available to the buying public.

Still yet another object of the present invention is to provide a new and improved golf bag umbrella which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of the invention illustrating a container mounted within the coil spring connection.

FIG. 9 is an isometric enlarged illustration of the container as set forth in FIG. 8.

DESCRIPTION OF THE PREFERRED EMBODIMENT

Figure 1:
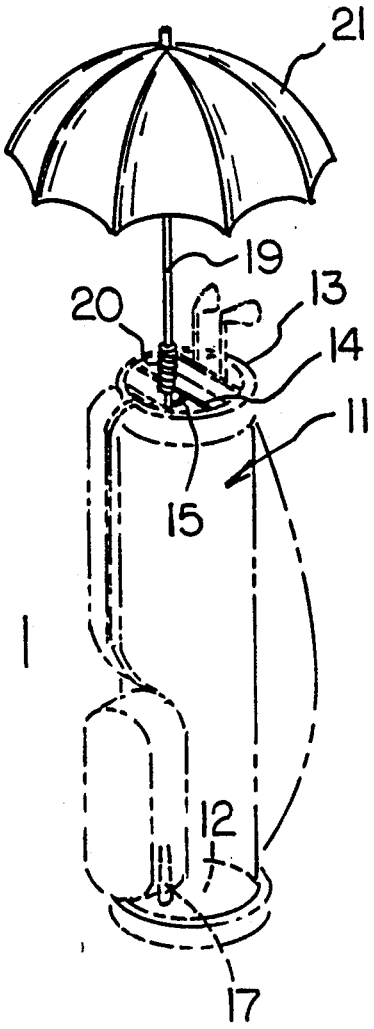
FIG. 1 is an isometric illustration of the invention mounted within an associated golf bag structure.
Figure 2:
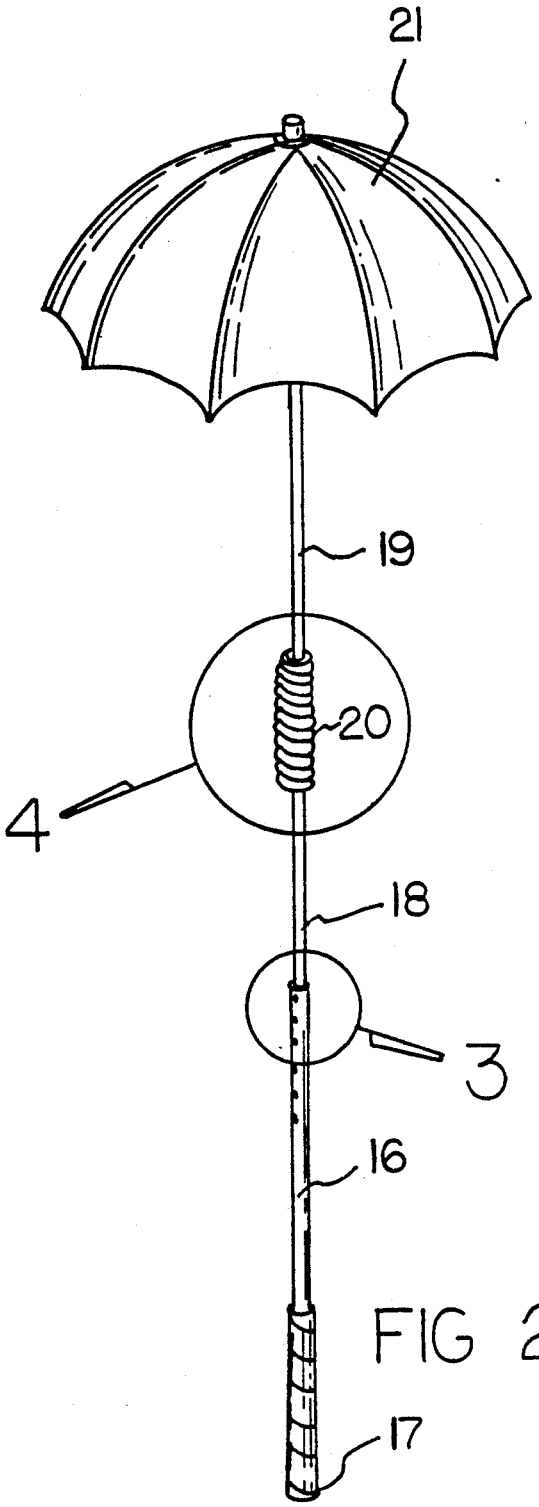
FIG. 2 is an isometric enlarged illustration of the invention.
Figure 4:
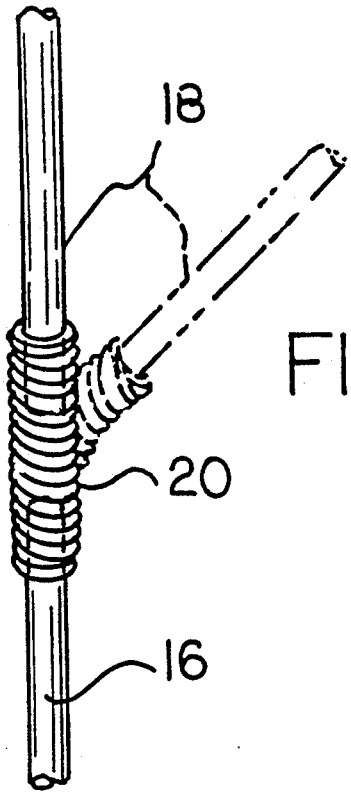
FIG. 4 is an isometric illustration of section 4 as set forth in FIG. 2.
Figure 5:
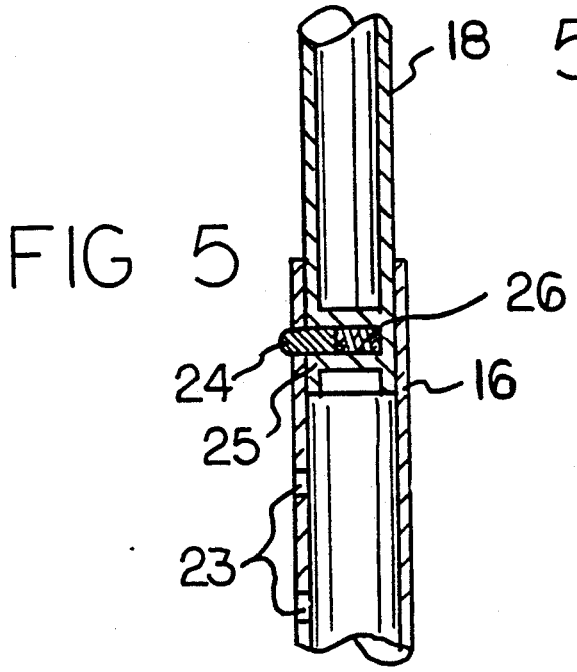
FIG. 5 is an orthographic view, taken along the lines 5—5 of FIG. 3 in the direction indicated by the arrows.
Figure 3:
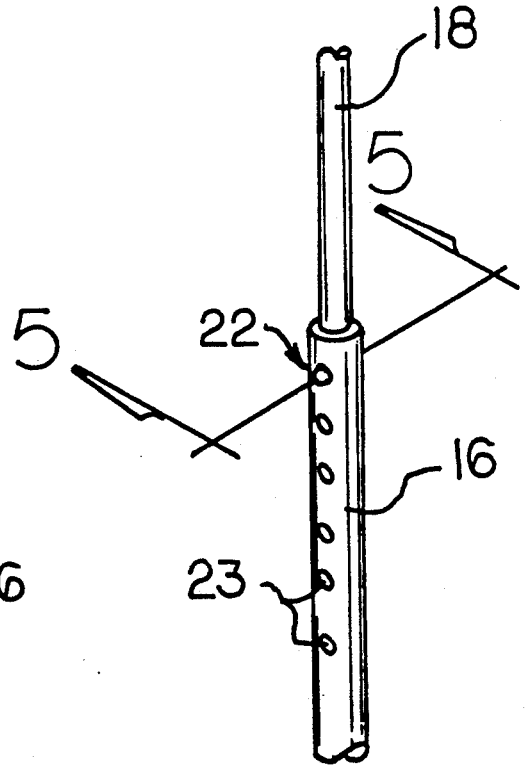
FIG. 3 is an isometric illustration of section 3 as set forth in FIG. 2.

With reference now to the drawings, and in particular to FIGS. 1 to 9 thereof, a new and improved golf bag umbrella embodying the principles and concepts of the present invention and generally designated by the reference numeral 10 will be described.

Figure 6:
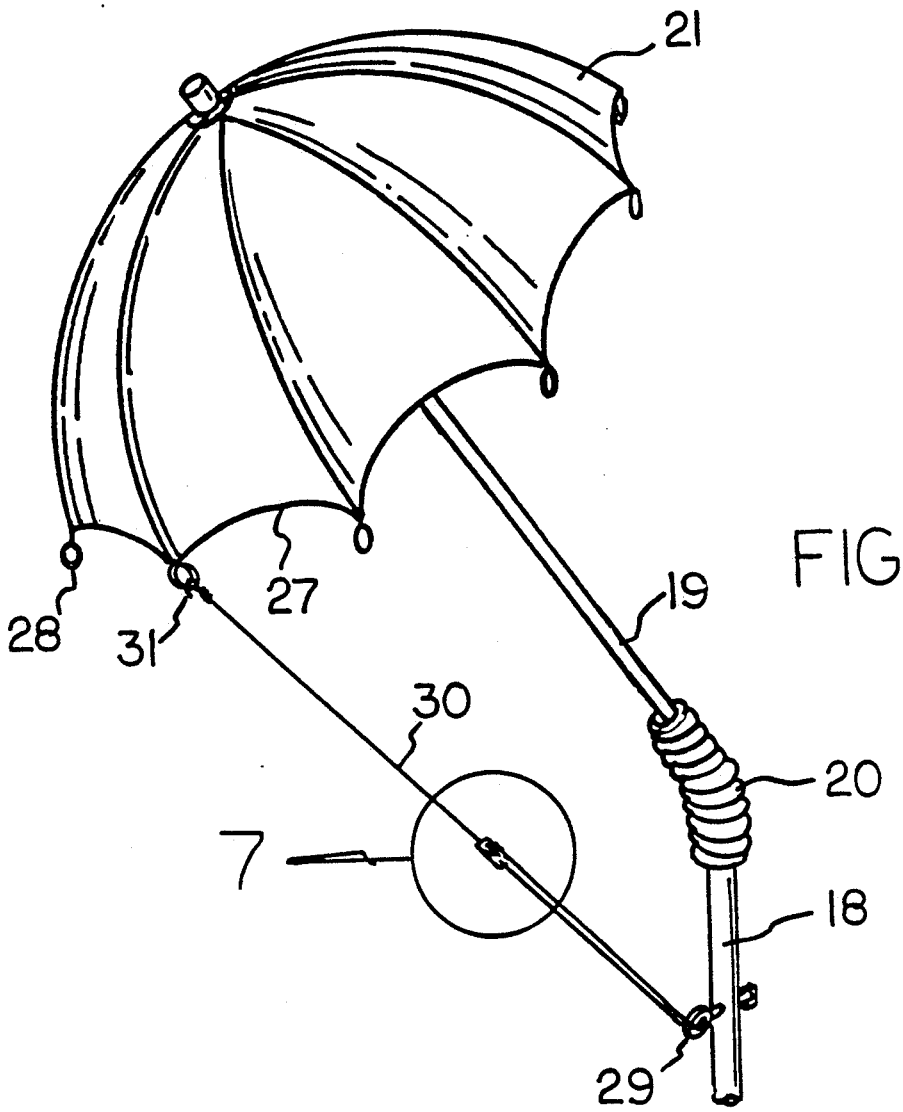
FIG. 6 is an isometric illustration of the invention employing an umbrella tipping structure for use by the invention.
Figure 7:
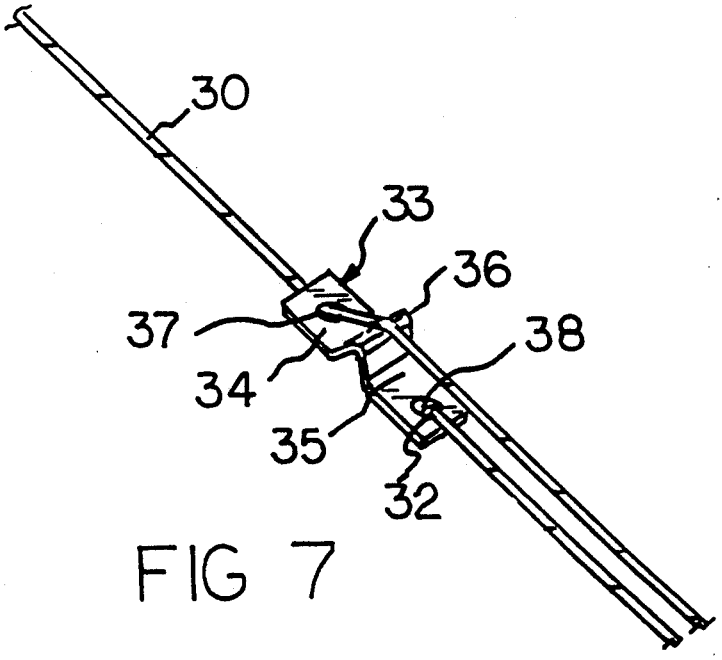
FIG. 7 is an enlarged isometric illustration of section 7 as set forth in FIG. 6.

More specifically, the golf bag umbrella 10 of the instant invention essentially comprises a golf bag 11 having a golf bag floor 12 and an entrance opening 13 spaced from the floor. The golf bag includes at least one divider wall 14, with a divider wall loop 15 receiving a handle shaft tube 16 therethrough, with the handle shaft tube having a covering foot 17 extending along the handle shaft tube from its lower distal end for positioning upon the golf bag floor 12. First and second extension tubes 18 and 19 are secured together in a first longitudinally aligned orientation relative to one another by a coil spring junction 20. In a first position, the handle shaft tube 16, the covering foot 17, the first extension tube 18, the second extension tube 19, and the coil spring junction 20 are coaxially aligned, wherein in a second position, the first and second extension tubes 18 and 19 are angulated relative to one another defining an oblique angle therebetween, as indicated in FIG. 6 for example.

A latch mechanism 22 permits selective telescoping securement of the first extension tube 18 relative to the handle shaft tube 16. A second extension tube 19 mounts an umbrella canopy 21 at its upper distal end for affording protection to the golf bag 11 and its contents.

The latch mechanism 22 is provided, with the latch mechanism operative through one of a plurality or row of apertures 23 extending along the handle shaft tube 16 to receive a plunger 24 within one of the apertures 23. The plunger 24 is mounted within a plunger housing 25 at a lower distal end of the first extension tube 18, wherein a plunger spring 26 interposed between the plunger 24 and the plunger housing 25 maintains the plunger 24 in an extended orientation through one of the apertures 23 to provide for selective telescoping orientation of the first extension tube 18 relative to the handle shaft tube 16.

The FIG. 6 indicates the umbrella canopy 21 having a canopy periphery 27, including a spaced plurality of rings 28 mounted to the periphery 27 extending below the periphery at intervals thereabout. An anchor ring 29 is mounted to the first extension tube 18 in adjacency to the coil spring junction 20. A flexible cord 30 having a hook 31 at a first end thereof secures the hook 31 to one of the rings 28. The cord 30 is thereafter directed through the anchor ring 29, with its second end secured to an arresting plate 33. The arresting plate 33 includes a first plate wing 34 coplanar with and spaced from a second plate wing 35. A central plate V-shaped ridge 36 extends between the first and second plate wings 34 and 35, with a flexible cord 30 directed over and orthogonally relative to the V-shaped ridge 36. A first wing aperture 37 directed through the first plate wing 34 slidably receives the cord 30 therethrough, with the second wing aperture 38 directed through the second wing 35 receiving fixedly the flexible cord second end 32. In this manner, sliding of the arresting plate 33 along the cord 30 permits selective positioning in a tilted orientation, the umbrella canopy 21 as indicated in FIG. 6.

FIG. 8 indicates the use of a cylindrical container 39 typically containing rosin powder or lotion for use by a golfer within a cylindrical cavity 41 of the coil spring junction 20. Displacement of the second extension tube relative to the first extension tube provides access to the cavity 41 for access to the container 39 having a removable container lid 40.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf bag umbrella, comprising, a handle shaft tube, the handle shaft tube having a covering foot, and the handle shaft tube including an entrance end, wherein the entrance end includes a first extension tube reciprocatably mounted within the handle shaft tube, the first extension tube includes a coil spring mounted to the first extension tube spaced from the handle shaft tube, and a second extension tube mounted to the coil spring, and an umbrella canopy mounted to the second extension tube spaced from the coil spring, wherein the handle shaft tube, the first extension tube, the second extension tube, and the coil spring junction are coaxially aligned in a first position, and wherein the first extension tube and the second extension tube are deflected relative to one another at an oblique angle relative to one another in a second position, and the first extension tube and the handle shaft tube include a latch mechanism, wherein the latch mechanism includes a row of apertures directed through the handle shaft tube, and the first extension tube includes a plunger housing mounted to a lower distal end of the first extension tube within the handle shaft tube, wherein the plunger housing includes a plunger, and a plunger spring captured between the plunger and the plunger housing to bias the plunger to one of said apertures, and the canopy includes a canopy periphery, and a plurality of spaced rings mounted about the canopy periphery, and an anchor ring mounted to the first extension tube below the coil spring, and a flexible cord, the flexible cord having a cord first end, the cord first end having a hook, and the hook directed through one of the spaced rings, and the cord directed slidably through the anchor ring, and the cord having a cord second end, wherein the cord second end includes an arresting plate, the arresting plate includes a first plate wing spaced from and coplanar with a second plate wing, the first plate wing includes a first wing aperture, the second plate wing includes a second wing aperture, and a central plate V-shaped ridge extending between the first plate wing and the second plate wing, and the flexible cord second end mounted to the second wing aperture, and the flexible cord directed orthogonally and slidingly over the V-shaped ridge and through the first wing aperture.

2. A golf bag umbrella as set forth in claim 1 including a golf bag, wherein the golf bag includes a golf bag floor and a golf bag entrance opening, and a divider wall mounted within the golf bag in adjacency to the entrance opening, the divider wall having a divider wall loop, wherein the handle shaft tube is directed through the loop.

3. A golf bag umbrella as set forth in claim 2 wherein the coil spring includes a coil spring cavity, and a cylindrical container, wherein the cylindrical container is removably mounted within the coil spring cavity.

* * * * *